US009523179B2

(12) United States Patent
Quirion

(10) Patent No.: US 9,523,179 B2
(45) Date of Patent: Dec. 20, 2016

(54) WINDOW WELL DRAINAGE SYSTEM FOR DRAINING SURFACE WATER RUNOFF AND METHOD FOR PERFORMING THE SAME

(71) Applicant: Gestion Jacques Quirion Inc., Lévis (CA)

(72) Inventor: Jacques Quirion, Lévis (CA)

(73) Assignee: Gestion Jacques Quirion Inc., Lévis (CA)

( * ) Notice: Subject to any disclaimer, the term of this patent is extended or adjusted under 35 U.S.C. 154(b) by 0 days.

(21) Appl. No.: 14/751,986

(22) Filed: Jun. 26, 2015

(65) Prior Publication Data

US 2016/0017569 A1 Jan. 21, 2016

Related U.S. Application Data

(60) Provisional application No. 62/017,572, filed on Jun. 26, 2014.

(51) Int. Cl.

| | |
|---|---|
| ***E02D 19/22*** | (2006.01) |
| ***E02D 31/02*** | (2006.01) |
| ***E04F 17/06*** | (2006.01) |

(52) U.S. Cl.

CPC ..... *E02D 31/02* (2013.01); *E02D 19/22* (2013.01); *E04F 17/06* (2013.01)

(58) Field of Classification Search

CPC ..... E04F 17/06; E03F 9/00; E04D 2013/0413; E02D 31/02; E02D 19/22

See application file for complete search history.

(56) References Cited

U.S. PATENT DOCUMENTS

| | | | | |
|---|---|---|---|---|
| 1,109,740 | A * | 9/1914 | Dehn | E03F 5/04 137/247.23 |
| 1,840,397 | A | 1/1932 | Keyes | |
| 4,691,487 | A | 9/1987 | Kessler | |
| 4,757,651 | A | 7/1988 | Crites | |
| 4,869,032 | A | 9/1989 | Geske | |
| 4,876,833 | A | 10/1989 | Gefroh | |
| 5,316,410 | A * | 5/1994 | Blume | E02D 31/02 405/36 |

(Continued)

OTHER PUBLICATIONS

NDS Pro, Principles of Exterior Drainage, Quick Review, Oct. 2007, 16 pages, NDS Pro, United States.

(Continued)

*Primary Examiner* — Andrew J Triggs
(74) *Attorney, Agent, or Firm* — Price Heneveld LLP

(57) ABSTRACT

A window well drainage system and method are provided. According to an aspect, the system comprises a window well base defining a window well cavity having a lowest end, a main drainage conduit opening in the window well cavity, a window well screening component engageable to cover the window well cavity and a drainage conduit screening component engageable to cover the upper port of the main drainage conduit, the window well screening component and the drainage conduit screening component being spaced apart from one another when engaged. According to another aspect, the system further comprises at least one secondary drainage conduit connectable to the main drainage conduit, said at least one secondary drainage conduit extending from the main drainage conduit to the foundation drain when connected to the main drainage conduit.

21 Claims, 3 Drawing Sheets

(56) References Cited

U.S. PATENT DOCUMENTS

| | | | | | |
|---|---|---|---|---|---|
| 5,339,579 | A * | 8/1994 | Woodyer | E04F 17/06 | 29/897.32 |
| 5,431,815 | A * | 7/1995 | Te-Shin | E03C 1/122 | 137/625.32 |
| D361,630 | S * | 8/1995 | Guernsey | E04F 17/06 | D25/152 |
| 5,444,950 | A * | 8/1995 | Kelly | E02D 31/02 | 405/43 |
| 5,501,044 | A | 3/1996 | Janesky | | |
| 5,836,115 | A | 11/1998 | Clay | | |
| 5,970,664 | A * | 10/1999 | Janesky | E04F 17/06 | 52/107 |
| 6,880,300 | B2 | 4/2005 | Hawkes | | |
| 6,883,279 | B2 | 4/2005 | Fukuro et al. | | |
| 7,574,829 | B1 | 8/2009 | Prager | | |
| 7,614,192 | B2 | 11/2009 | Safie | | |
| 2005/0072080 | A1 * | 4/2005 | Coscarella | E03F 9/00 | 52/302.1 |
| 2016/0017569 | A1 * | 1/2016 | Quirion | E02D 31/02 | 52/169.5 |

OTHER PUBLICATIONS

Crackpro, Window Well Installation, online, http://foundationrepaircornwall.com/products-services/window-well-installation/.

Mississippi Foundation Repair Specialist Co., Drainage Solutions, online, http://www.levelhome.com/drains.aspx.

Basement Systems, Inc., Basement Window Well Drain, online, htip://www.basementsystems.com/basement-waterproofing/basement-waterproofing-products/basement-windows/window-well-drain.html.

* cited by examiner

WINDOW WELL DRAINAGE SYSTEM FOR DRAINING SURFACE WATER RUNOFF AND METHOD FOR PERFORMING THE SAME

CROSS-REFERENCE TO RELATED APPLICATIONS

This Application claims priority under 35 USC §119(e) of U.S. provisional patent application 62/017,572 filed on Jun. 26, 2014, the entirety of which is hereby incorporated by reference.

TECHNICAL FIELD

The technical field relates to the field of drainage systems for evacuating surface runoff out of the area surrounding basement windows. More particularly, it relates to a window well drainage system for draining surface water runoff into a foundation drain and a method for performing same.

BACKGROUND OF THE INVENTION

An important feature of basement windows relates to admit daylight in the basement of a building by defining an opening space around such sub-grade windows. Additionally, most building codes in North America require that dwellings include an emergency egress, such as an egress window, for each habitable room, including the one inhabited in the basement.

However, an important disadvantage of basement windows extending below the ground level is that they can be prone to seepage of infiltrating surface water runoff around and through the interface of the windows and their frame. There is thus a need to drain efficiently the surface water runoff from the area surrounding basement windows to the foundation drain or any other mean to evacuate the water.

Window wells address the needs and requirements specified hereinabove. In its basic configuration, the basement window is enclosed within a retaining wall which further confines the soil to form a well area which extends below the lower level of the window frame opening. Commonly, the window well area defines a dry well filled with stones, wherein the surface water runoff is drained gravitationally until it reaches the foundation drain on its bottom end.

However, such window wells require a minimum of maintenance in order to prevent the clogging of the window well area. Moreover, the presence of expansive soils in the surrounding environment may inflict structural damages to window wells, as well as to foundation walls. Once clogged or impaired, window wells can no longer evacuate surface water runoff through the foundation drain, and the accumulation of water nearby the basement windows may cause imminent water infiltration predicament.

In view of the above, there is a need for an improved window well drainage system which, by virtue of its design and components, would be able to overcome or at least minimize some of the above-discussed prior art concerns.

SUMMARY OF THE INVENTION

It is therefore an aim of the present invention to address the above mentioned issues.

According to a general aspect, there is provided a window well drainage system comprising: a window well wall defining a window well cavity; a main drainage conduit having an upper port extending in the window well cavity and a lower port in liquid communication with a foundation drain; and at least one secondary drainage conduit in liquid communication with the main drainage conduit, the at least one secondary drainage conduit extending from the main drainage conduit to a foundation drain.

According to another general aspect, there is provided a window well drainage system comprising: a window well wall defining a window well cavity with a lower surface and being open at a top thereof; a main drainage conduit having an upper port extending above the lower surface of the window well and a lower port in liquid communication with a foundation drain; a window well screening component mounted to the window well wall and extending above the window well cavity; and a drainage conduit screening component covering the upper port of the main drainage conduit, the window well screening component and the drainage conduit screening component being spaced apart from one another.

According to still another general aspect, there is provided a method for draining surface water runoff to a foundation drain using a window well drainage system having a window well cavity. The method comprises: receiving the surface water runoff into the window well cavity; flowing the surface water runoff into a main drainage conduit having an upper port in liquid communication with the window well cavity; and directing the surface water runoff flowing into the main drainage conduit into a plurality of available paths reaching the foundation drain.

According to a further general aspect, there is provided a window well drainage system comprising: a window well base defining a window well cavity having a lowest end; a main drainage conduit having an upper port extending above the lowest end of the cavity and a lower port extending below the window well base and being connectable to a foundation drain for liquid communication therewith; a window well screening component engageable to cover the window well cavity; and a drainage conduit screening component engageable to cover the upper port of the main drainage conduit, the window well screening component and the drainage conduit screening component being spaced apart from one another when engaged.

In an embodiment, the main drainage conduit comprises an upper section extending in the window well cavity and including the upper port. The upper section of the main drainage conduit extending within the window well cavity cab be removably engageable with the window well base.

In an embodiment, the window well base comprises an open end opposite the lowest end of the window well cavity and the upper port of the main drainage conduit extends below the open end of the window well base. The open end of the window well base can comprise at least one straight side configured for placement adjacent a window. The open end can be substantially rectangular-shaped. The window well base can comprise sidewalls extending upwardly from the lowest end of the window well cavity, the sidewalls comprising an upper end defining the open end of the window well cavity. The upper port of the main drainage conduit can extend below the upper end of the sidewalls. The sidewalls can define a receptacle configured to retain water and debris entering through the open end of the window well cavity and channel the water towards the upper port of the main drainage conduit. The sidewalls can comprise a peripheral ledge configured to support the window well screening component. The upper port of the main drainage conduit can extend below the peripheral ledge of the sidewalls of the window well base.

In an embodiment, the window well cavity comprises a depression surrounding the main conduit for accumulating debris. The window well cavity can be substantially funnel-shaped.

In an embodiment, the window well base further comprises a section of the main drainage conduit extending below the window well base.

In an embodiment, the upper section of the main drainage conduit extending within the window well cavity comprises sidewalls sloping away from the upper port. The window well base can comprise a peripheral wall configured to support the upper section of the main drainage conduit extending within the window well cavity. The main drainage conduit can further comprise an extension section removably engageable with the window well base.

In an embodiment, the window well screening component is removably engageable with the open end of the cavity.

In an embodiment, the drainage conduit screening component comprises an atrium grate.

In an embodiment, the window well screening component comprises a flat grate.

In an embodiment, the window well base is flexibly connectable to at least a section of the main drainage conduit below the upper port.

In an embodiment, the main drainage conduit comprises a main section mounted to the window well base and an extension section engageable with the main section. The main section and the extension section can be flexibly connectable to one another.

In an embodiment, the window well screening component is configured to screen particles of a first mesh size, and the drainage conduit screening component is configured to screen particles of a second mesh size, the second mesh size being smaller than the first mesh size.

In an embodiment, at least one of the window well screening component and the drainage conduit screening component comprises at least one selected from a group consisting of: a grate, a grid, a mesh, a strainer, a filter bag and a woven textile.

In an embodiment, the window well base further comprises a window well wall extending peripherally and upwardly therefrom along at least a section thereof.

In an embodiment, the window well drainage system further comprises at least one secondary drainage conduit securable to the main drainage conduit, said at least one secondary drainage conduit extending from the main drainage conduit to the foundation drain.

According to still another general aspect, there is provided a window well drainage system comprising: a window well base defining a window well cavity having a lowest end; a main drainage conduit having an upper port located in the window well cavity and a lower port connectable to a foundation drain for liquid communication therewith; and at least one secondary drainage conduit connectable to the main drainage conduit for liquid communication therewith, said at least one secondary drainage conduit extending from the main drainage conduit to the foundation drain when connected to the main drainage conduit.

In an embodiment, the window well drainage system according to claim 28, wherein the upper port of the main drainage conduit extends above the lowest end of the window well cavity.

In an embodiment, the at least one secondary drainage conduit comprises a lower port, the lower port of the main drainage conduit and the lower port of the secondary drainage conduit being spaced apart from one another in the foundation drain.

In an embodiment, the window well base is flexibly connectable to at least a section of the main drainage conduit below the upper port.

In an embodiment, the main drainage conduit comprises a main section connectable to the window well base and an extension section connectable to the main section. The main section and the extension section of the main drainage conduit can be flexibly connectable to one another.

In an embodiment, the at least one secondary drainage conduit comprises a plurality of secondary drainage conduits providing a plurality of parallel paths for fluid flowing from the main drainage conduit to the foundation drain.

In an embodiment, the window well drainage system further comprises a window well screening component covering the open end of the well cavity and a drainage conduit screening component covering the upper port of the main drainage conduit.

According to still another general aspect, there is provided a method for draining water to a foundation drain, comprising: providing a window well drainage system having a window well cavity and a main drainage conduit; allowing the water to flow into the window well cavity while screening particles of a first mesh size; allowing the water to flow into the main drainage conduit while screening particles of a second mesh size, the second mesh size being smaller than the first mesh size; and channeling the water from the main drainage conduit into the foundation drain.

In an embodiment, the method further comprises the steps of accumulating particles having a mesh size between the first and second mesh sizes in the window well cavity around the main drainage conduit, and channeling the water in the main drainage conduit through a plurality of parallel paths terminating in the foundation drain.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION OF THE PREFERRED EMBODIMENTS

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the window well drainage system and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the window well drainage system, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Figure 1:
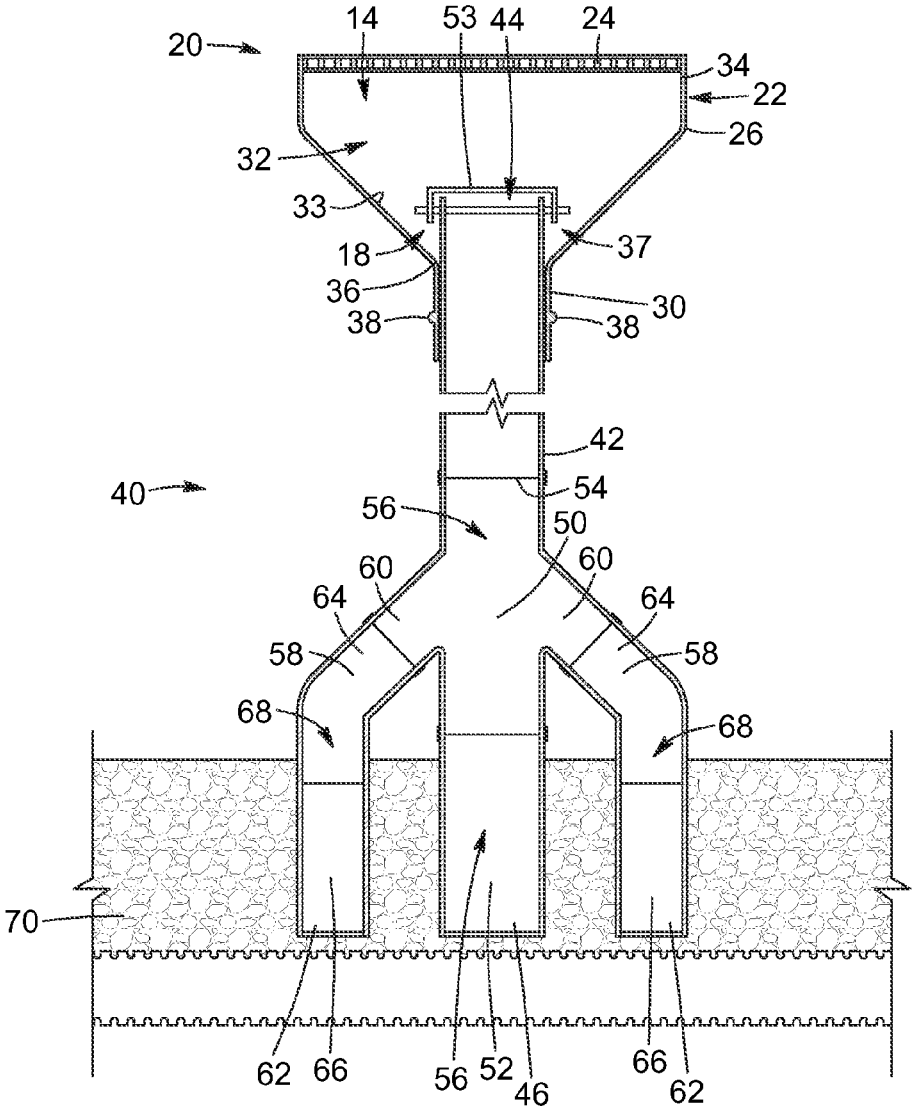
FIG. 1 is a schematical cross-section view of a window well drainage system in accordance with an embodiment.

Referring to the drawings and more particularly to FIG. 1, there is provided an embodiment of a window well drainage system 20. More particularly, the window well drainage system 20 comprises a window well base 22 and a drainage assembly 40. The window well drainage system 20 can also include a window well wall (not shown) extending from the window well base 22 and configured to surround a basement window (not shown), The window well base 22 comprises sidewalls 26 which define a window well cavity 32 having an upper end 34 and a lowest end 36. In the embodiment shown, the window well cavity 32 is substantially funnel-shaped, i.e. it is wider at the upper end 34 than at the lowest end 36. The sidewalls 26 are configured to keep the soil out of the window well cavity 32. The drainage assembly 40 includes a main drainage conduit 42 with an upper port 44 extending above the lowest end 36 of the window well cavity 32 (or a lower surface 33 of the window well). In the embodiment shown, a lower section 30 of the window well base 22 is flexibly mounted to the main drainage conduit 42, close to but below the upper port 44.

Figure 2:
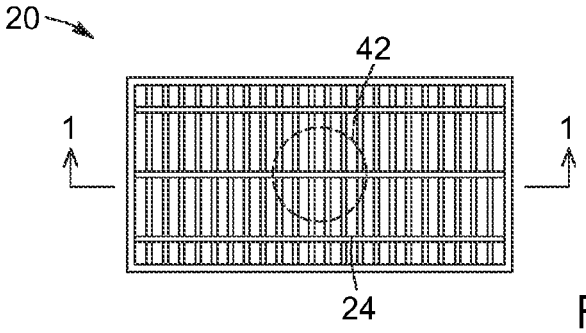
FIG. 2 is a top plan view of the window well drainage system shown in FIG. 1.

Referring now to FIGS. 1 and 2, there is shown that the window well drainage system 20 comprises a window well screening component 24, such as and without being limitative a grate, removably engageable with an upper end 34 of the window well cavity 32, above the window well cavity 32. The window well screening component 24 prevents relatively coarse elements and/or debris (not shown), i.e. elements of diameter equal or superior to a mesh size of the above-mentioned window well screening component 24, from entering into the window well cavity 32. The window well drainage system 20 further comprises a main conduit cover screening component 53, such as and without being limitative a grid, removably mounted to the upper port 44 of the main drainage conduit 42 and covering the upper port 44 thereof. Similarly, the main conduit cover screening component 53 prevents relatively fine elements (not shown), (i.e. elements of diameter equal or superior to a mesh size of the above-mentioned main conduit cover screening component 53) accumulated inside a receptacle 14 defined in the window well cavity 32 from entering into the main drainage conduit 42 of the drainage assembly 40. In an alternative embodiment, other types of screening component can be employed in the window well drainage system 20, such as a debris strainer, a cloth filter bag, a woven geotextile, or the like.

Since the upper port 44 of the main drainage conduit 42 extends above the lowest end 36 of the window well cavity 32, a depression 37 surrounds the main drainage conduit 42. The intercepted relatively fine elements accumulate in the depression 37 and are thus accessible, by removing the window well screening component 24, to be recovered. In aggregate terms, the window well drainage system 20 comprises two screening components 24 and 53, spaced-apart from one another, wherein the first screening components 53 prevents relatively coarse elements from entering the window well base 22 while allowing relatively fine elements to amass into the window well cavity 32.

As mentioned above, in the embodiment shown, the window well base 22 and the main drainage conduit 42 are engaged together through a flexible connection 38. The flexible connection 38 enables the window well base 22 to move independently from the drainage assembly 40, thereby preventing any impairment of the window well drainage system 20 when surrounding soil displacements happen, for instance and without being limitative during a thaw period. In an embodiment, the lower section 30 of the window well base 22 comprises a ductile component, such as and without being limitative a cast iron spigot and socket joint, or the like, to engage with the main drainage conduit 42. In an alternative embodiment, other types of flexible connection 38 can be fitted to the lower section 30 of the window well base 22, between the main drainage conduit 42, such as rubbers, thermoplastic elastomers, or the like.

In an embodiment, the main drainage conduit 42 further comprises an expansion joint 54, such as and without being limitative a rubber bellow, or the like. The expansion joint 54 extends between two contiguous sections of the conduit 42. It is appreciated that the main drainage conduit 42 can include a plurality of spaced-apart expansion joints 54. Similarly as for the lower section 30 of the window well base 22, the main drainage conduit 42 being extensible at the expansion joint 54, the window well drainage system 20 can support surrounding soil displacements, for instance and without being limitative during a thaw period. In an alternative embodiment, the main drainage conduit 42 can comprise other types of pipe expansion joints 54, such as a bellow of plastic, or the like.

In the embodiment shown in FIG. 1, an upper section 18 of the main drainage conduit 42 above the lowest end 36 of the window well cavity 32. The main drainage conduit 42 extends from the upper port 44, extending above the lowest end 36 of the window well cavity 32, to a foundation drain 70 of the building. The main drainage conduit 42 further comprises a lower port 46 fluidically opened into the foundation drain 70. In the embodiment shown, the main drainage conduit 42 can be divided into three continuous sections: the upper section 18 including the upper port 44, a lower section 52 including the lower port 46, and an intermediate section 50 extending between the upper section 18 and the lower section 52, below the window well base 22.

In addition to the main drainage conduit 42, in the embodiment shown, the drainage assembly 40 comprises at least one secondary drainage conduit 58 extending downwardly from the intermediate section 50 of the main drainage conduit 42 to the foundation drain 70. In the embodiment shown, the drainage assembly 40 comprises two secondary drainage conduits 58, each one extending, first outwardly in an upper section 64 and then downwardly substantially parallel to the main drainage conduit 42 in a lower section 66, on a respective side of the main drainage conduit 42. Each one of the secondary drainage conduits 58 comprises an upper port 60 in liquid communication with the intermediate section 50 of the main drainage conduit 42 and a lower port 62 fluidically opened in the foundation drain 70. However, one skilled in the art will understand that, in an alternative embodiment, the window well drainage system 20 can comprise only one or a great number of secondary drainage conduits 58, or the like. Flexible attachments similar to the expansion joint 54 of the main drainage conduit 42 can also be supplemented or retrofitted to one and/or a plurality of the secondary drainage conduit(s) 58.

In the embodiment shown, the lower port 62 of each one of the secondary drainage conduits 58 and the lower port 46 of the main drainage conduit 42 are spaced-apart from one another into the foundation drain 70. In an alternative embodiment, the arrangement of the lower ports 46, 62 into the foundation drain 70 can be asymmetrical.

The above-described window well drainage system 20 can be used to drain surface water runoff into the foundation drain 70. The surface water runoff first penetrates into the window well cavity 32, wherein the relatively coarse elements and/or debris (not shown) are intercepted by the window well screening component 24, thereby preventing the relatively coarse elements and/or debris from entering into the window well drainage system 20.

A portion of the surface water runoff (including relatively finer elements having a diameter inferior to the mesh size of the main conduit cover screening component 53) flows directly into the main drainage conduit 42 through the upper port 44 of the conduit 42, whereas a remaining portion of the surface runoff accumulates in the depression 37 in the lowest end 36 of the window well cavity 32, surrounding the main drainage conduit 42. Relatively fine elements settle and accumulate in the depression 37, while a supernatant portion of the collected surface runoff flows through the upper port 44 of the conduit 42 into the drainage assembly 40.

Then, the secondary drainage conduit(s) 58 and the main drainage conduit 42 provide the surface water runoff with a plurality of available flowing paths to the foundation drain 70, the plurality of paths comprising a main flowing path 56 and at least one alternative flowing path 68. The main flowing path 56 is defined in the main drainage conduit 42 and extends from the upper port 44 to the lower port 46 thereof. Similarly, each one of the alternative flowing path 68 extends from the upper port 44 of the main conduit 42 to the lower port 62 of a respective one of the secondary drainage conduits 58. In the illustrated embodiment, the flowing paths are parallel flowing paths. In other words, the paths diverge at a common junction, allowing water to flow through the most convenient path. In this fashion, if one path is blocked downstream from the common junction, the blocking of that path will not impact the flow of water through the other parallel paths.

In the embodiment shown in FIG. 1, the surface water runoff is provided with one main flowing path 56 and two alternative flowing paths 68. Thus, if the lower section 52 of the main drainage conduit 42 is clogged, the surface water runoff can still flow from the upper section 18 of the main drainage conduit 42 to the at least one secondary drainage conduit 58, wherein the surface water runoff is evacuated in the foundation drain 70 through the lower port 62 of each secondary drainage conduit 58. Similarly, if one of the secondary drainage conduits 58 is clogged, the surface water runoff can still flow from the upper section 18 to the lower section 52 of the main drainage conduit 42, wherein the water is evacuated into the foundation drain 70 through the lower port 46 of the main drainage conduit 42.

Figure 3:
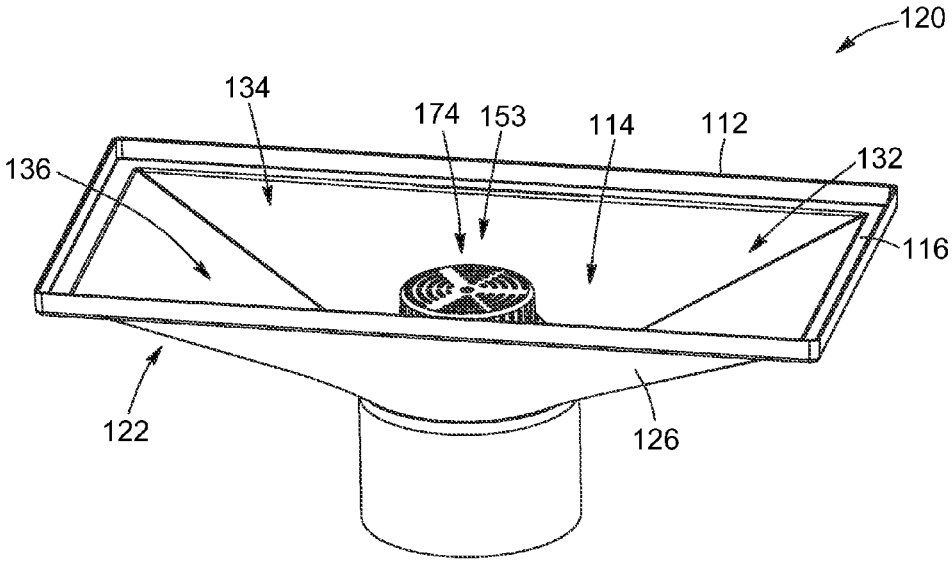
FIG. 3 is a perspective view of a window well drainage system in accordance with an alternate embodiment, wherein a window well base includes a section of a main drainage conduit.
Figure 4:
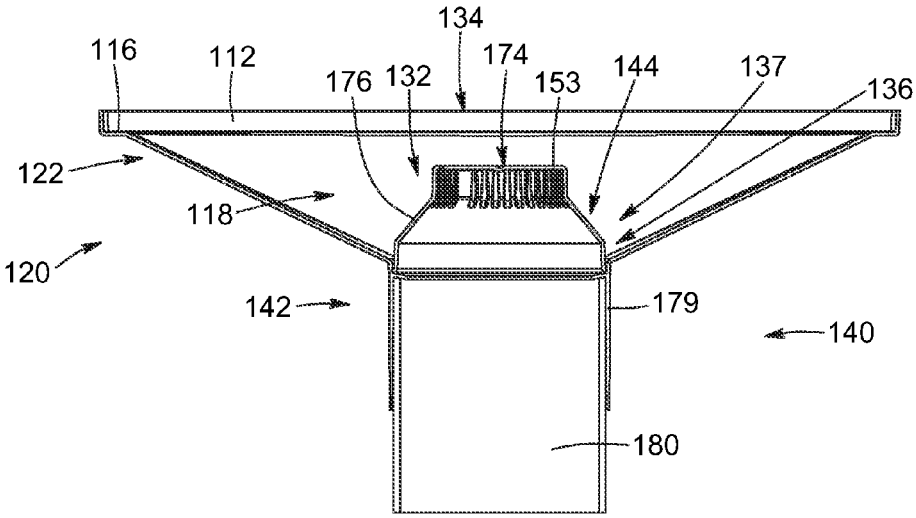
FIG. 4 is a cross-section view of the window well drainage system of FIG. 3, having an extension section of the main drainage conduit engaged with the section of the main drainage conduit integral included in the window well base.

With reference now to FIGS. 3 and 4, a window well base 122 for a window well drainage system 120 is shown according to an alternate embodiment wherein the features are numbered with reference numerals in the 100 series which correspond to the reference numerals of the previous embodiment. The window well drainage system 120 comprises a window well base 122 with sidewalls 126 having an upper end 112. The sidewalls 110 define a cavity 132 with an open and upper end 134 opposite a lowest end 136. Water contained in the cavity 132 is channeled towards the lowest end 136.

In the illustrated embodiment, the sidewalls 126 are configured such the cavity 132 is substantially rectangular-shaped at the upper end 134. Other configurations are also possible, preferably where the cavity has at least one straight side (not shown) sized such that it can be placed adjacent a window and run along the entire length of the window. For example, the cavity 132 could have the shape of a semi-circle.

As can be appreciated, the upper port 144 of the main drainage conduit 142 extends above the lowest end 136 of the cavity 132 and below the upper end 112 of the sidewalls 126 (which corresponds to the upper end 134 of the cavity 132). In this fashion, water and debris can accumulate inside a receptacle 114 defined in the cavity 132, before eventually rising high enough to drain through the upper port 144. Since the upper port 144 extends below the upper end 112 of the sidewalls 126, a window well screening component (not shown), similar to the window well screening component 24 of the above-described embodiment, can rest on the upper end 112, for example on a peripheral ledge 116 thereof, without interfering with the upper port 144.

In the illustrated embodiment, the window well base 122 also includes a section 179 of the main drainage conduit 142 extending downwardly from the lowest end 136 of the cavity 132. More particularly, the section of the main drainage conduit 142 comprises an upper section 118 extending in the window well cavity 32, and a second section 172 extending below the window well base 122. In the embodiment shown, the upper section 118 of the main drainage conduit 142 is single piece with the main conduit screening component 153. More particularly, the upper section 118 comprises an atrium grate 174 through which water can flow to the upper port 144 of the main drainage conduit 142. It also comprises sidewalls 176 which extend upwardly from the lowest end 136 of the cavity 132 and slope away from the main conduit screening component 153 aligned with the upper port 144. In the embodiment shown, the upper section 118 is removably engageable with the window well base 122. For example, it can abut against a peripheral wall 178 extending inwardly in the window well base 122.

As for the above-described embodiment, a depression 137 surrounds the main drainage conduit 142. The intercepted relatively fine elements accumulate in the depression 137.

The second section 172 of the main drainage conduit 142 is in liquid communication with the upper port 144 and the upper section 118. In the embodiment shown in FIG. 4, the second section 172 includes a main section 179 and an extension section 180. In the embodiment shown, the main section 179 extends continuously and downwardly from the sidewalls 126 and is in liquid communication with the upper section 118. In the embodiment shown in FIG. 4, the extension section 180 is engaged with the window well base 122 by having an upper section thereof inserted in the main section 179, below the lowest end 136 of the cavity 132. In the embodiment shown, the extension section 180 is adjacent to the upper section 118 at a lower section thereof. The length of the extension section 180 can be adjusted in accordance with the needs and can include one or more flexible connections (not shown). The extension section 180 can be engaged with the main section 179 via flexible connection 182.

In the embodiment shown, the main section 179 is part of the window well base 122 and extends continuously from the sidewalls 126 defining the cavity 132.

Figure 5:
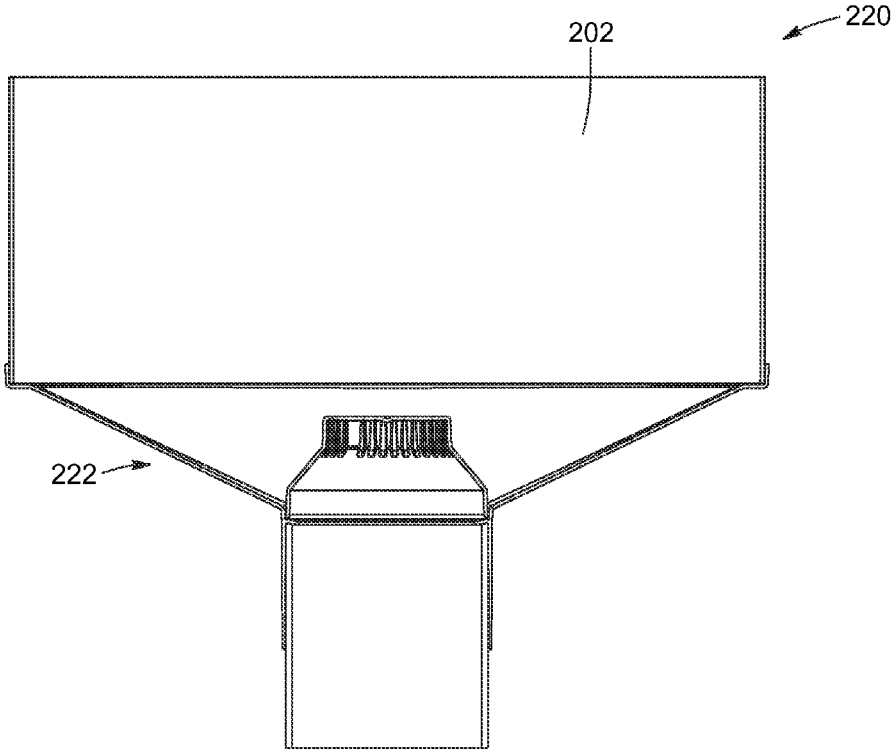
FIG. 5 is a schematic of a window well drainage system in accordance with an alternate embodiment provided with a window well wall.

The embodiments of FIGS. 1 to 4 can, for example, be provided at the bottom of a window well defined by window well walls. In an alternate embodiment however, such as the one shown in FIG. 5, the window well drainage system 220 can have a window well wall 202 integrally formed therein. In the illustrated embodiment, the window well wall 202 extends peripherally from the window well base 222. In an embodiment, the window well wall 202 extends at least along a section of the window well base 222, for example along three of four sides thereof, the fourth side being installed adjacent a window. Of course, in alternate embodiments, the window well wall 202 can extend along more or fewer sides of the base 201.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments can be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A window well drainage system for a window well having window well walls and a bottom, the window well drainage system comprising:

a window well base provided in the bottom of the window well, the window well base comprising sidewalls defining a window well base cavity having an open end opposite a lowest end;

a main drainage conduit engaged with the window well base and extending therethrough, the main drainage conduit having an upper port extending above the lowest end of the window well base cavity and a lower port extending below the window well base and being connectable to a foundation drain for liquid communication therewith;

a window well base screening component engageable with the window well base to cover the open end of the window well base cavity, the window well base screening component allowing water to pass therethrough into the window well base cavity when the window well base screening component covers the open end of the window well base cavity; and a drainage conduit screening component covering the upper port of the main drainage conduit, the drainage conduit screening component allowing water to pass therethrough into the main drainage conduit after having passed through the window well base screening component, the window well base screening component extending above the drainage conduit screening component.

2. The window well drainage system according to claim 1, wherein the main drainage conduit comprises an upper section extending in the window well base cavity and including the upper port.

3. The window well drainage system according to claim 2, wherein the upper section of the main drainage conduit extending within the window well base cavity is removably engageable with the window well base.

4. The window well drainage system according to claim 1, wherein the upper port of the main drainage conduit extends below the open end of the window well base cavity.

5. The window well drainage system according to claim 4, wherein the sidewalls extend upwardly from the lowest end of the window well base cavity and comprise an upper end defining the open end of the window well base cavity, and the upper port of the main drainage conduit extends below the upper end of the sidewalls.

6. The window well drainage system according to claim 5, wherein the sidewalls define a receptacle configured to retain water and debris entering through the open end of the window well base cavity and channel the water towards the upper port of the main drainage conduit.

7. The window well drainage system according to claim 1, wherein the window well base cavity is substantially funnel-shaped and comprises a depression surrounding the main conduit for accumulating debris.

8. The window well drainage system according to claim 1, wherein the window well base further comprises a section of the main drainage conduit extending below the window well base.

9. The window well drainage system according to claim 1, wherein the main drainage conduit comprises a main section mounted to the window well base and an extension section engageable with the main section and the main section and the extension section are flexibly connectable to one another.

10. The window well drainage system according claim 1, wherein the window well base screening component is configured to screen particles of a first mesh size, and the drainage conduit screening component is configured to screen particles of a second mesh size, the second mesh size being smaller than the first mesh size.

11. The window well drainage system according to claim 1, wherein the window well base further comprises at least a portion of the window well walls, the portion of the window well walls extending peripherally and upwardly from the sidewalls of the window well base along at least a section thereof.

12. The window well drainage system according to claim 1, further comprising at least one secondary drainage conduit securable to the main drainage conduit, said at least one secondary drainage conduit extending from the main drainage conduit to the foundation drain, the main drainage conduit and the at least one secondary drainage conduit ending spaced apart from one another in the foundation drain.

13. The window well drainage system according to claim 1, wherein when engaged, the window well screening component is spaced apart from at least a portion of the drainage conduit.

14. A window well drainage system for a window well having window well walls and a bottom, the window well drainage system comprising:

a window well base provided in the bottom of the window well to cover the window well, the window well base comprising sidewalls defining a window well base cavity having an open end opposite a lowest end;

a main drainage conduit engaged with the window well base and extending therethrough, the main drainage conduit having an upper section including an upper port located in the window well base cavity, a lower section including a lower port connectable directly to a foundation drain, and an intermediate section extending between the upper and lower sections, the main drain conduit providing a main flowing path for fluid to the foundation drain;

a window well base screening component engageable with the window well base to cover the open end of the window well base cavity, the window well base screening component allowing water to pass therethrough into the window well base cavity when the window well base screening component covers the open end of the window well base cavity;

a drainage conduit screening component covering the upper port of the main drainage conduit, the drainage conduit screening component allowing water to pass therethrough into the main drainage conduit after having passes through the window well base screening component, the window well base screening component extending above the drainage conduit screening component; and at least one secondary drainage conduit connectable to the main drainage conduit, said at least one secondary drainage conduit having an upper port and a lower port, the at least one secondary drainage conduit extending from the main drainage conduit to the foundation drain when connected to the main drainage conduit, said at least one secondary drainage conduit providing at least one alternative flowing path for fluid to the foundation drain through the upper port by having the upper port in liquid communication with the main drainage conduit and the lower port fluidically opened in the foundation drain, the at least one alternative flowing path diverging from the main flowing path at a common junction point in the intermediate section of the main drainage conduit and ending in the foundation drain.

15. The window well drainage system according to claim 14, wherein the upper port of the main drainage conduit extends above the lowest end of the window well base cavity.

16. The window well drainage system according to claim 14, wherein the lower port of the main drainage conduit and the lower port of the secondary drainage conduit are spaced apart from one another in the foundation drain.

17. The window well drainage system according to claim 14, wherein the window well base is flexibly connectable to at least a section of the main drainage conduit below the upper port.

18. The window well drainage system according to claim 14, wherein the main drainage conduit comprises a main section connectable to the window well base and an extension section connectable to the main section, and wherein the main section and the extension section of the main drainage conduit are flexibly connectable to one another.

19. The window well drainage system according to claim 14, wherein the at least one secondary drainage conduit comprises a plurality of secondary drainage conduits providing a plurality of parallel paths for fluid flowing from the main drainage conduit to the foundation drain, the plurality of secondary drainage conduits ending spaced apart in the foundation drain.

20. A method for draining water to a foundation drain from a window well having window well walls and a bottom, the method comprising:

providing a window well base at the bottom of the window well, the window well base comprising sidewalls defining a window well base cavity having an open end extending below the window well walls;

providing a window well base screening component engaged with the window well base and covering the open end of the window well base cavity, a main drainage conduit in fluid communication with the window well base cavity, and a drainage conduit screening component engaged with the main drainage conduit, the drainage conduit screening component being contained in the window well base cavity and extending below the window well base screening component;

allowing the water to flow into the window well base cavity while screening particles of a first mesh size through the window well base screening component;

allowing the water having passed through the window well base screening component to subsequently flow into the main drainage conduit while screening particles of a second mesh size through the drainage conduit screening component, the second mesh size being smaller than the first mesh size; and channeling the water from the main drainage conduit into the foundation drain.

21. The method for draining water to the foundation drain according to claim 20, further comprising the steps of accumulating particles having a mesh size between the first and second mesh sizes in the window well base cavity around the main drainage conduit, and channeling the water in the main drainage conduit through a plurality of parallel paths terminating in the foundation drain, the plurality of paths ending spaced apart from one another in the foundation drain.

* * * * *